US005636578A

United States Patent [19]

Rizzi

[11] Patent Number: 5,636,578

[45] **Date of Patent: *Jun. 10, 1997**

[54] FOLDING TABLE LEG CONSTRUCTION

[75] Inventor: John J. Rizzi, Weston, Conn.

[73] Assignee: Steelcase, Inc., Grand Rapids, Mich.

[ * ] Notice: The term of this patent shall not extend beyond the expiration date of Pat. No. 5,562,051.

[21] Appl. No.: 450,089

[22] Filed: May 25, 1995

Related U.S. Application Data

[63] Continuation-in-part of Ser. No. 249,391, May 26, 1994, Pat. No. 5,562,051.

[51] Int. Cl.[6] ..... A47B 3/00

[52] U.S. Cl. ..... 108/129; 108/132

[58] Field of Search ..... 108/129, 132, 108/133, 131; 248/188.6

[56] References Cited

U.S. PATENT DOCUMENTS

| | | | |
|---|---|---|---|
| 441,569 | 11/1890 | Ladd . | |
| 2,075,778 | 3/1937 | Johannsen . | |
| 2,318,945 | 5/1943 | Johannsen . | |
| 2,657,963 | 11/1953 | Fox . | |
| 2,666,683 | 1/1954 | Pucci . | |
| 2,695,827 | 11/1954 | De Saussure, Jr. . | |
| 2,756,082 | 7/1956 | Pucci | 108/131 X |
| 3,349,728 | 10/1967 | Barecki et al. . | |
| 4,573,415 | 3/1986 | Ramey | 108/129 |
| 4,658,735 | 4/1987 | Holton . | |
| 4,827,851 | 5/1989 | Diffrient . | |
| 4,838,180 | 6/1989 | Gutgsell . | |
| 5,279,233 | 1/1994 | Cox | 108/129 |
| 5,323,713 | 6/1994 | Luyk et al. | 108/131 |
| 5,345,881 | 9/1994 | Loescher | 108/132 |
| 5,528,997 | 6/1996 | Miller . | |

FOREIGN PATENT DOCUMENTS

| | | | |
|---|---|---|---|
| 155398 | 6/1932 | Switzerland | 108/132 |
| 8001508 | 7/1980 | WIPO | 248/188.6 |

*Primary Examiner*—Jose V. Chen

*Attorney, Agent, or Firm*—Price, Heneveld, Cooper, DeWitt & Litton

[57] ABSTRACT

A table includes a tabletop and a pair of opposing folding leg assemblies. Each folding leg assembly includes a base plate secured to the tabletop. A folding leg is pivotally connected to the base plate by a linkage arrangement that includes a first link pivotally connecting the folding leg to the base to define first and second axes of rotation and a second link pivotally connecting the folding leg to the base to define third and fourth axes of rotation. The second link includes a transverse section, and a latch is secured to the base plate for releasably engaging the transverse section when the folding leg is in the extended position. The first link also includes a transverse section or recess for engaging the latch to hold the folding leg in the folded position.

22 Claims, 10 Drawing Sheets

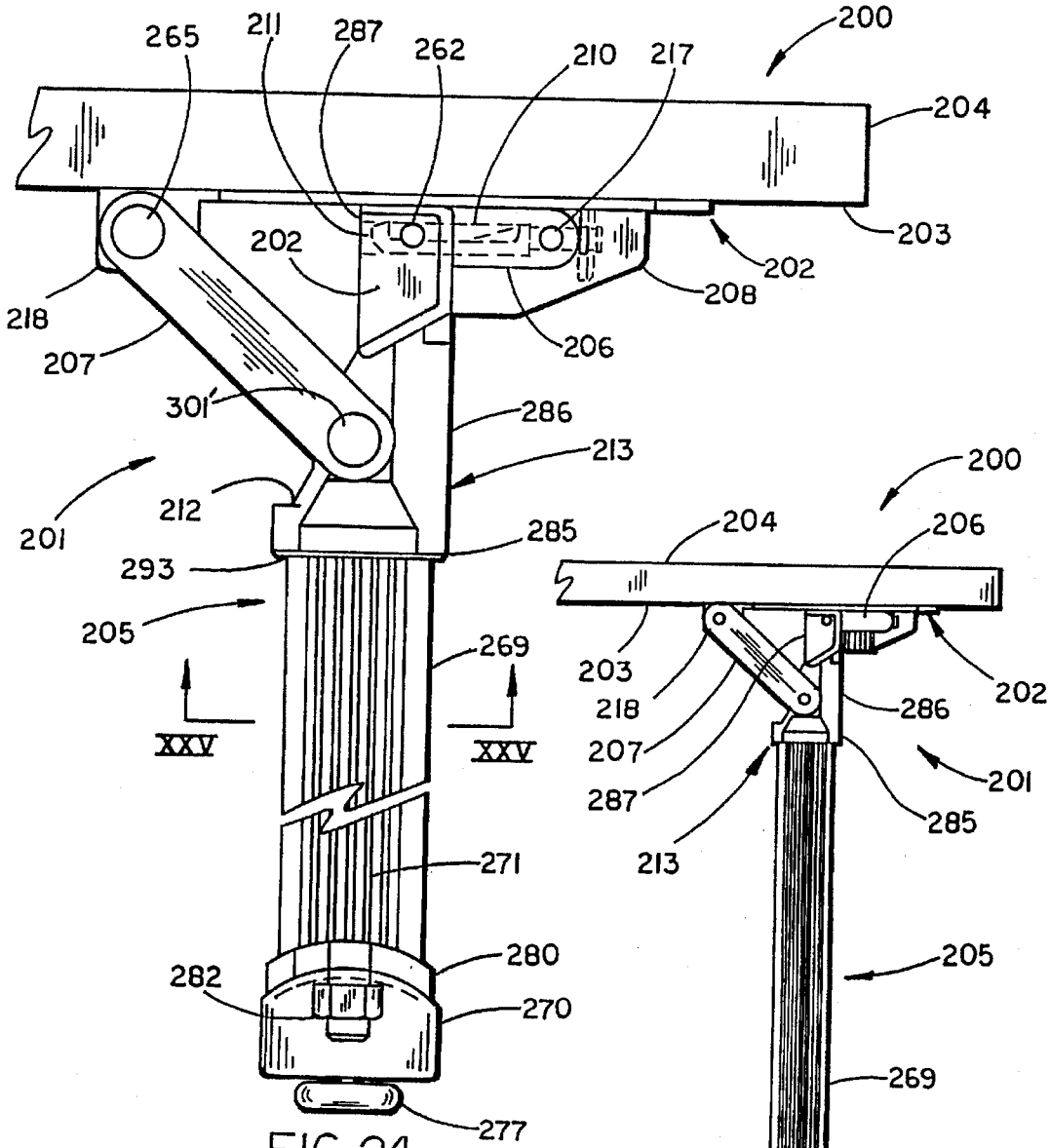
FIG. 24
FIG. 23
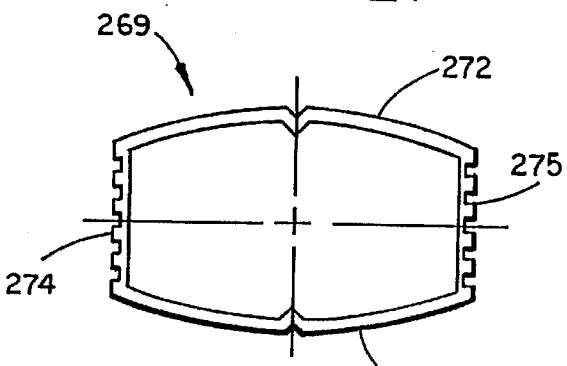
FIG. 25

FOLDING TABLE LEG CONSTRUCTION

CROSS-REFERENCE TO RELATED APPLICATION

This is a continuation-in-part application of a U.S. patent application entitled FOLDING TABLE LEG CONSTRUCTION, Ser. No. 08/249,391, filed May 26, 1994, now U.S. Pat. No. 5,562,051 to inventor John J. Rizzi, which is commonly assigned.

BACKGROUND OF THE INVENTION

The present invention relates to tables, and in particular to a table including folding legs movable between a secure extended position for use and a compact folded position to facilitate storage.

Tables are often provided with folding legs that move between an extended position and a folded position to facilitate set-up, tear-down, shipment and storage. A latching mechanism is usually provided on the folding legs to hold the legs in the extended position so that they do not accidentally unexpectedly collapse during use. However, many latching mechanisms are unsightly and less than attractive. Also, the latching mechanisms can be difficult and/or awkward to operate, or do not retain the legs in the extended position as securely as desired. Aside from the problems of latching mechanisms, it is desirable to fold the legs flat against the tabletop to provide a minimum thickness to facilitate storage. This is a problem where a pair of opposing folding legs on a table each include a transverse member near the bottom of the legs and the legs are so long that they overlap at the bottom when in the folded position. The overlapping legs not only can damage and scratch each other, but also the legs are prevented from laying flat against the tabletop, thus requiring additional storage space. As a result, in many known tables having folding legs, the folded position of the legs at least partially dictates the style and design of the legs. Further, the legs may accidentally swing partially out of the folded position, causing difficulty when storing the table or causing the legs to scratch against adjacent tables.

Thus, an improved table including latchable folding legs solving the aforementioned problems is desired. Also, a hinge arrangement is desired which is easily assembled to a tabletop, which maximizes efficient use of the space under the tabletop, and which also facilitates movement of the legs into and out of the folded position.

SUMMARY OF THE INVENTION

One aspect of the present invention includes a table having a tabletop, and a folding leg movably connected to the tabletop by a four bar linkage arrangement for movement between an extended position for supporting the tabletop and a folded position for storage. The four bar linkage arrangement includes links, and a releasable latch is provided for releasably engaging one of the links to hold the folding leg in the extended position and for releasably engaging one of the links to hold the folding leg in the folded position.

These and other features and advantages of the present invention will be further understood and appreciated by those skilled in the art by reference to the following specification, claims and appended drawings.

BRIEF DESCRIPTION OF THE DRAWINGS

FIG. 23 is a fragmentary side view of another table including a modified single post folding leg embodying the present invention, the folding leg being shown in an extended position;

FIG. 24 is an enlarged fragmentary side view of the table shown in FIG. 23;

FIG. 25 is a cross-sectional view taken along the plane XXV—XXV in FIG. 24;

DETAILED DESCRIPTION OF PREFERRED EMBODIMENT

Figure 2:
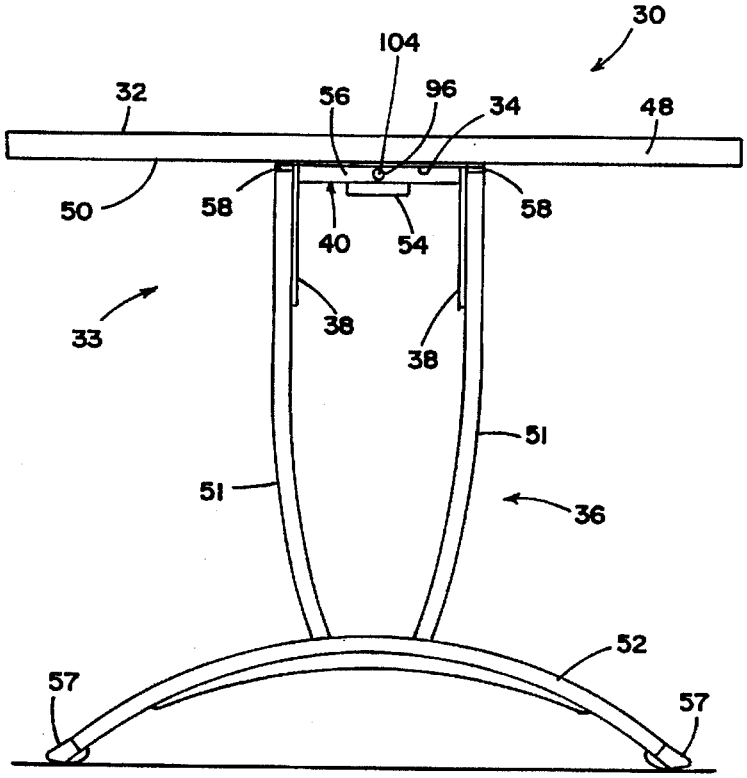
FIG. 2 is an end view of the table shown in FIG. 1.

For purposes of description herein, the terms "upper," "lower," "right," "left," "rear," "front," "vertical," "horizontal" and derivatives thereof shall relate to the invention as oriented in FIG. 2, the front of the table being toward the left of the page. However, it is to be understood that the invention may assume various alterative orientations, except where expressly specified to the contrary. It is also to be understood that the specific drawings and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
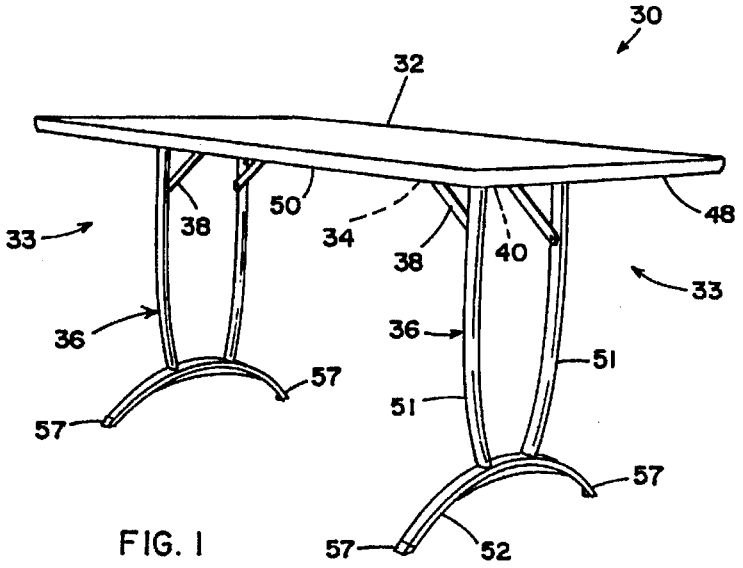
FIG. 1 is a perspective view of a table including folding legs embodying the present invention.
Figure 3:
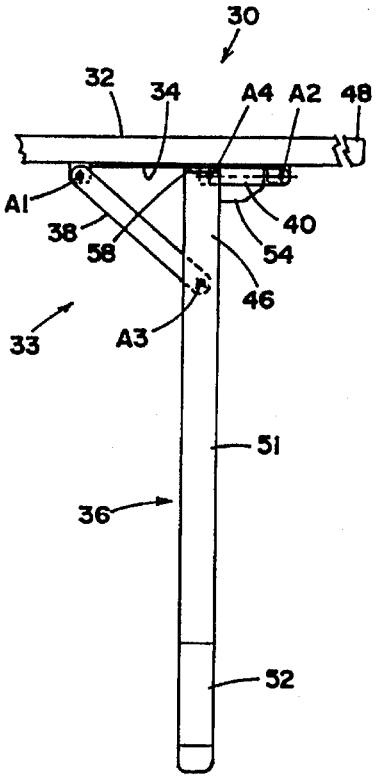
FIG. 3 is a fragmentary side view of the table shown in FIG. 1.
Figure 4:
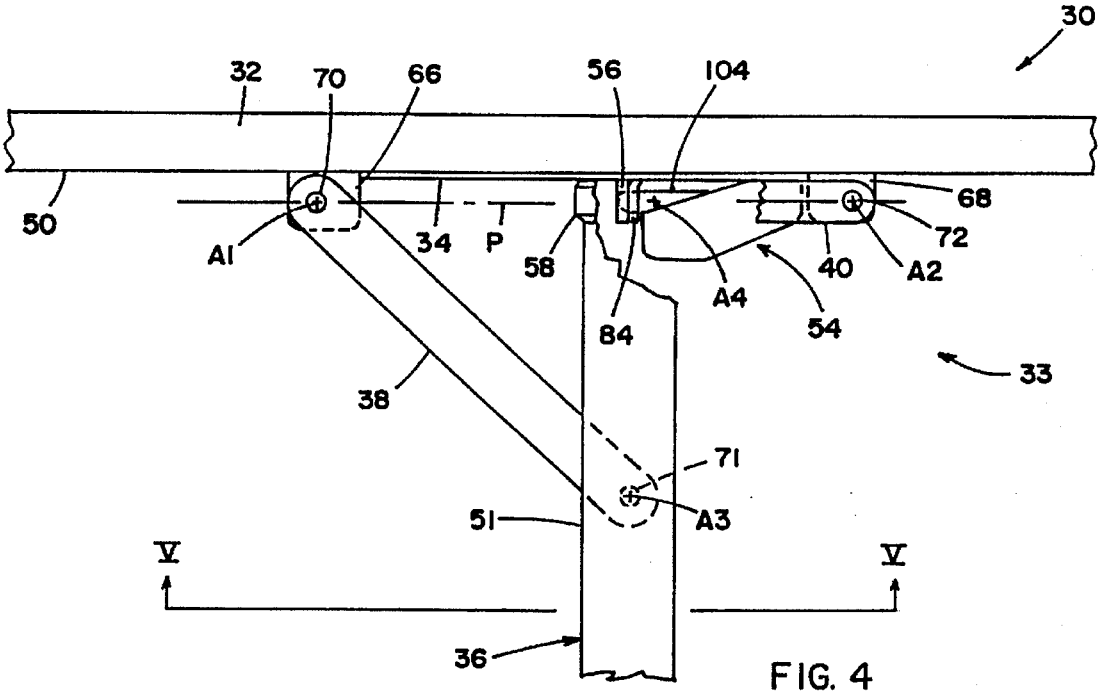
FIG. 4 is an enlarged fragmentary side view of the folding leg and the linkage arrangement shown in FIG. 3, the folding leg being latched in the extended use position.
Figure 16:
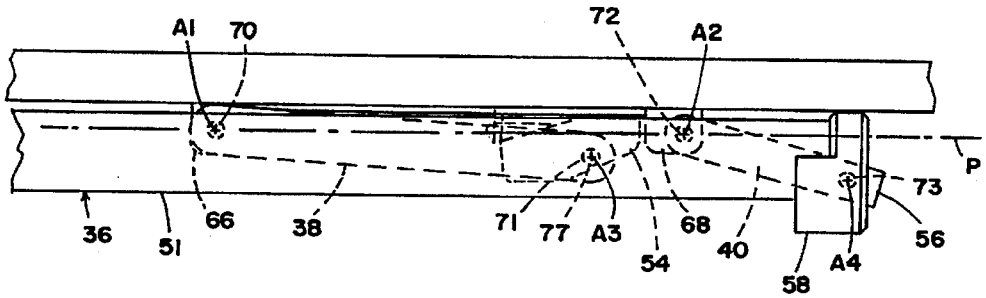
FIGS. 16–19 are side views showing a leg being moved from a folded position (FIG. 16) to an extended and nearly latched position (FIG. 19)

A table 30 (FIG. 1) embodying the present invention includes a tabletop 32 and a pair of folding leg assemblies 33 secured to the bottom surface of tabletop 32. Leg assemblies 33 (FIG. 2) each include a leg supporting base plate 34, and a folding leg 36 movably connected to base plate 34 by a "four bar" linkage arrangement including links 38 and 40. Links 38 and 40 are pivotally connected to base plate 34 and to leg 36 at separated axes A1–A4 (FIG. 3) such that the upper portion 46 of leg 36 swings toward an edge 48 of tabletop 32 as leg 36 is moved from an extended position (see FIGS. 1–4) to a folded position (FIG. 16). This movement improves the utilization of space under the table 30, so that inverted Y-shaped collapsible legs 36 having a transverse floor-engaging member 52 at their lower end can be used without transverse member 52 overlapping onto an adjacent leg 36. A latch 54 (FIG. 5) is attached to base plate 34, and link 40 includes a transverse section 56 that frictionally engages latch 54 when in the extended position to increase the stability of legs 36 when table 30 is in use. Axes A1–A4 (FIG. 16) are offset from each other so that they cannot be moved to an "over center" or "on center" position when legs 36 are in the folded position. This prevents a lock up condition and thus facilitates moving the legs 36 from the folded position to the extended position.

Tabletop 32 (FIG. 1) is generally planar and rectangular, although different shapes and sizes can be used. Tabletop 32 includes an edge 48 extending around the perimeter of tabletop 32, and a bottom surface 50.

Folding legs 36 (FIGS. 2–3) have an inverted Y-shaped construction and include a pair of beam-like weight bearing tubular members 51 interconnected at the bottom by transverse arcuately-shaped floor-engaging member 52. Weight bearing members 51 have an elliptical tubular cross section which provides aesthetics and also adds strength to leg 36. The lateral spacing of tubular members 51 and the span of transverse floor-engaging member 52 also add stability to the overall structure. Transverse member 52 rigidly interconnects weight bearing members 51, and it is contemplated that additional transverse members can be added to further rigidify leg 36 if desired. A pair of caps 57 made of a molded material are secured to the ends of transverse floor-engaging member 52 to prevent damage to the floor/support surface that supports table 30. Also, caps 58 (FIGS. 4–5) are secured to the upper end of tubular members 51 for engaging base plate ears 74A. Cap 58 prevents undesirable wear and/or noise as tabletop 32 shifts relative to legs 36 during use. Legs 36 have an inverted Y-shaped construction for aesthetics and optimal stability, however the present invention is contemplated to include alterative leg constructions. It is noted that the present hinge arrangement is particularly suited for securing legs which cannot overlappingly mateably fold into each other as the legs are moved to the folded position adjacent bottom surface 50 of tabletop 32.

Figure 7:
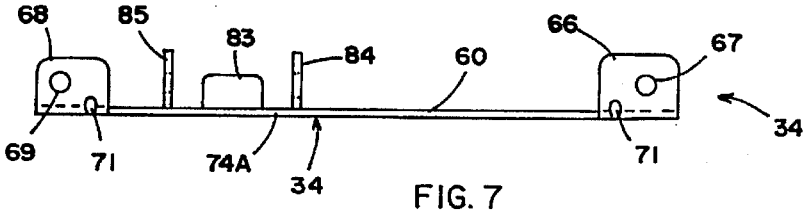
FIG. 7 is a side view of the base plate shown in FIG. 6.

Base plate or bracket 34 (FIG. 7) includes a planar tabletop-engaging section 60 for stably engaging the bottom surface 50 (FIG. 5) of tabletop 32. Holes 62 are provided in planar section 60 for receiving screws 64 to secure base plate 34 to tabletop 32, although it is noted that other fastening mechanisms can be used. The dimensions of planar section 60 are chosen based on the width of tubular members 51 in legs 36, the functional requirements of table 30 and the strength of the material comprising tabletop 32 and legs 36. Pivot-forming flanges 66 and 68 (FIG. 7) are located at the corners of planar section 60 and extend perpendicularly downwardly from tabletop 32. Gussets 71 are formed at the juncture of planar section 60 and flanges 66 and 68 to strengthen and stabilize flanges 66 and 68. Holes 67 and 69 are located in flanges 66 and 68, respectively, for receiving pivot pins 70 and 72 (FIG. 5) to pivotally connect links 38 and 40 to base plate 34. Holes 67 and 69 define the first and second axes of rotation "A1" and "A2" for links 38 and 40, as discussed below. Planar section 60 includes ears 74A that engage the two caps 58 at the upper ends of tubular members 51 when leg 36 is in the extended position. Cutouts 78, 79 and 80 are located around the perimeter of planar section 60 as desired to reduce weight. Also, the cutouts 78, 79 and 80 provide a distinctive attractive appearance.

Four integral tabs 82–85 (FIGS. 6–9) are formed from the material in the center of planar section 60. Tabs 82–85 form a rectangular pattern for holding latch 54. Tabs 82 and 83 are located in opposing spaced apart relationship between the edges of tabs 84 and 85. Tab 84 includes a square hole 86 and tab 85 includes a round hole 87 which cooperate with latch 54, as described below.

Figure 5:
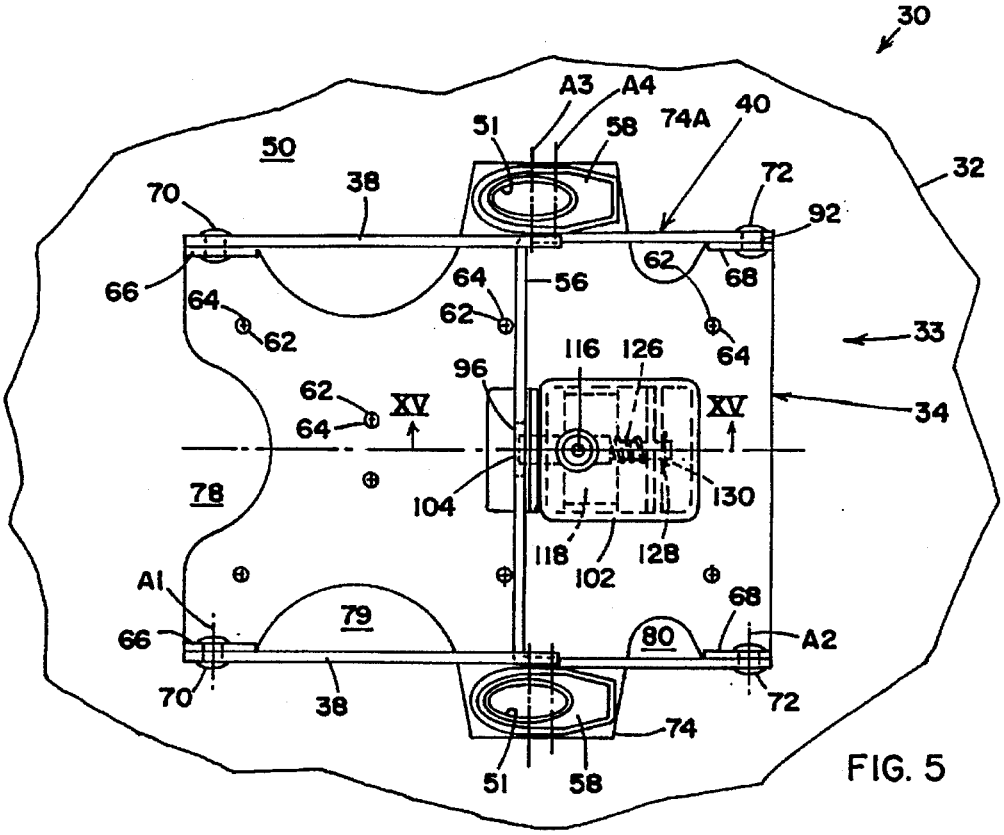
FIG. 5 is a fragmentary bottom cross-sectional view of the folding leg and the hinge arrangement shown in FIG. 4.
Figure 6:
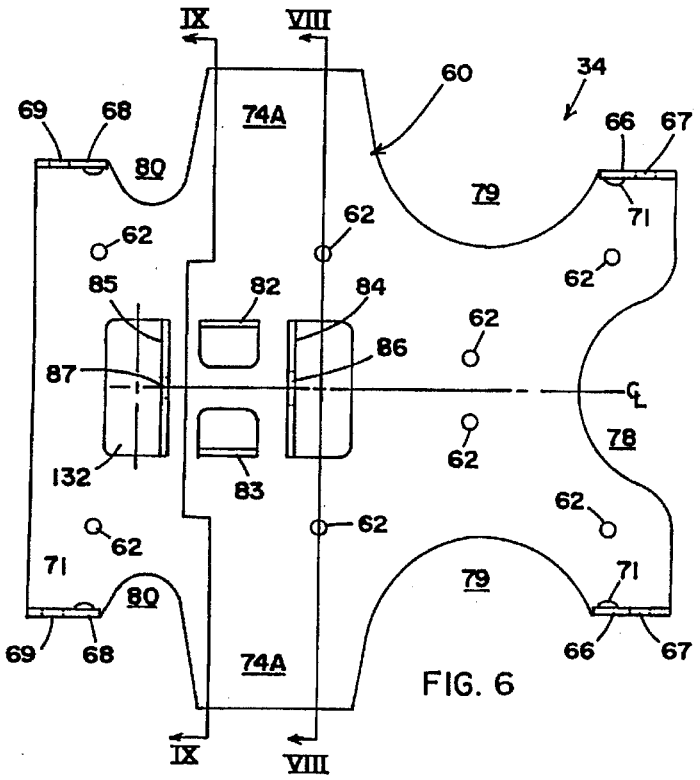
FIG. 6 is an enlarged plan view of the leg supporting base plate shown in FIG. 5.
Figure 8:
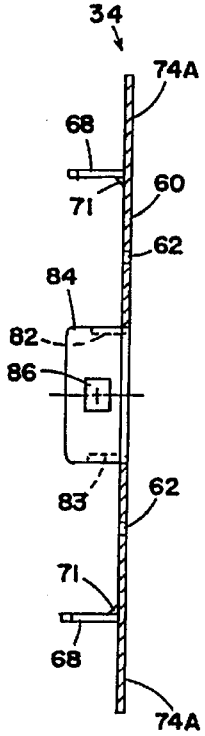
FIGS. 8–9 are cross-sectional views taken along the planes VIII—VIII and IX—IX in FIG. 6.
Figure 9:
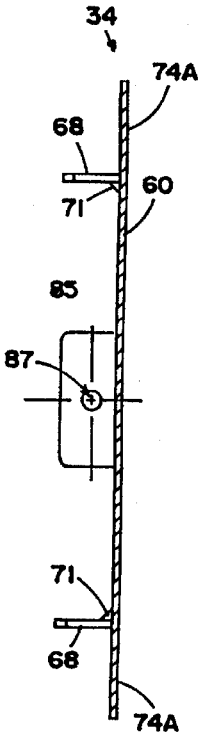
Figure 10:
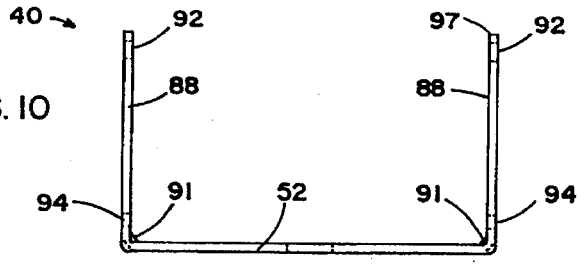
FIGS. 10–12 are orthogonal views of the U-shaped link shown in FIG. 5.
Figure 11:
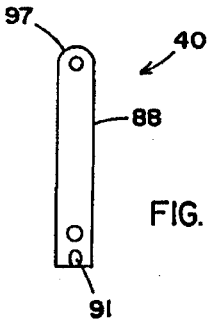
Figure 12:
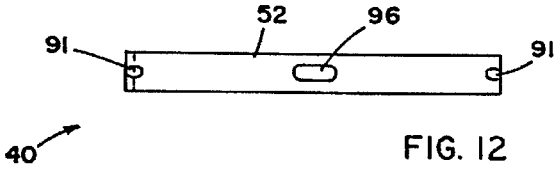
Figure 18:
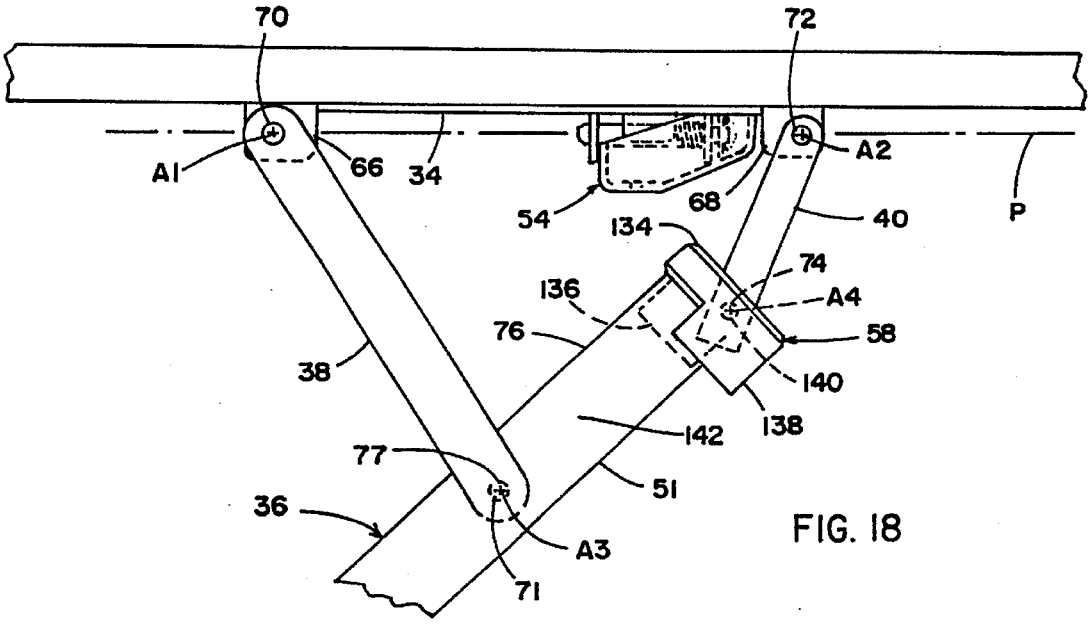

There are two links 38 and one link 40 in each folding leg assembly 33 (FIG. 5). Links 38 are planar and include holes at each end and are pivotally attached to base plate flange 66 by pivot pin 70 and to table leg 36 by pivot pin 71. Pivot pin 71 defines the third axis of rotation "A3." Link 40 (FIGS. 10–12) is U-shaped and includes side sections 88 interconnected by the transverse section 56. Gussets 91 are formed on the corners connecting sections 88 and 56 to stabilize the sections relative to each other. Side sections 88 include pivot-forming holes 92 and 94. Pivot pin 72 pivotally engages pivot-forming holes 92 to connect link 40 to the pivot-forming flanges 68 on base plate 34 and pivot pin 74 (FIG. 18) pivotally engages pivot-forming holes (94) on link 40 and securely engages cap 58 on leg 36 to pivotally connect link 40 to leg 36. Pivot pin 74 defines the fourth axis of rotation "A4." A square hole 96 is formed in transverse section 56 for frictional engagement by the tapered end of latch 54. The free ends 97 (FIG. 11) of side sections 88 are rounded to facilitate the pivoting motion of link 40 as leg 36 is moved between the folded position and the extended position.

Figure 13:
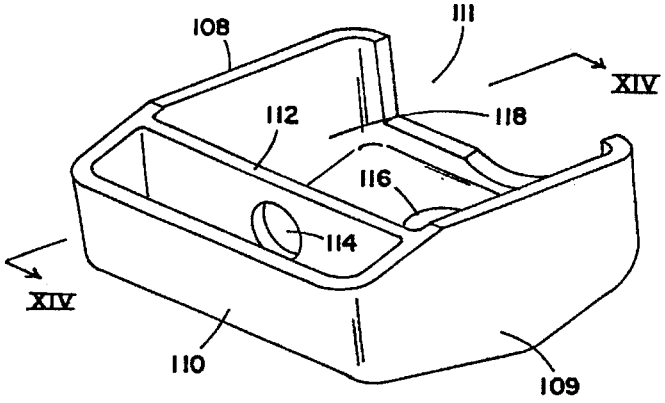
FIG. 13 is a perspective view of the latch housing shown in FIG. 5.
Figure 14:
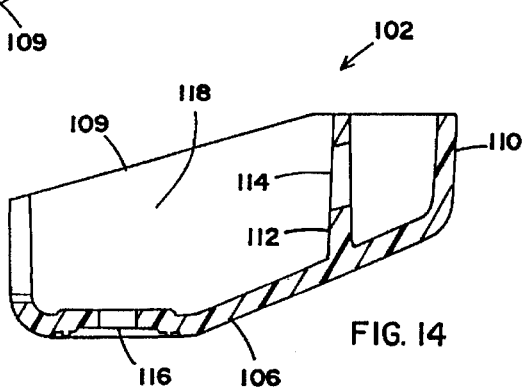
FIG. 14 is a cross-sectional view taken along the plane XIV—XIV in FIG. 13.
Figure 15:
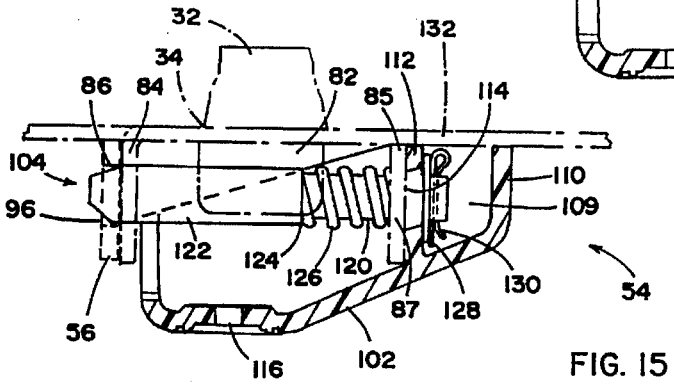
FIG. 15 is an enlarged side cross-sectional view of the releasable latch taken along the plane XV—XV in FIG. 5, the base plate and tabletop being shown in phantom.

Latch 54 (FIG. 15) includes a cup-shaped housing 102 and a latching member 104 slideably positioned in housing 102. Housing 102 (FIGS. 13–14) includes a bottom cover section 106, sidewalls 108 and 109, and an end wall 110 defining a pocket 118. An open end 111 is defined between sidewalls 108 and 109 at one end of housing 102 opposite end wall 110. An intermediate wall 112 extends between sidewalls 108 and 109. A hole 114 is located in intermediate wall 112 for slideably receiving the shaft of latching member 104. An access hole 116 in the bottom cover section 106 allows access to the pocket 118 defined within housing 102, such as for accessing latch member 104 after assembly. Notably, it is contemplated that access hole 116 could be enlarged or expanded into a slot, and a handle (not shown) could be attached to latching member 104 and extended through the slot so that an operator could manually move latching member 104 to a retracted release position against the bias of latch-biasing spring 126, discussed below.

When housing 102 (FIG. 15) is assembled to base plate 34, housing sidewalls 108 and 109 engage the outside surfaces of flanges 82 (and 83) to securely hold latch 54 in a centered position on base plate 34. Also, end wall 110 and intermediate wall 112 are located between and adjacent flanges 84 and 85, respectively. Latching member 104 includes a round shaft section 120 that fits slideably mateably into hole 114 in intermediate wall 112 and further fits slideably mateably into round hole 87 in tab 85. Latching member 104 further includes a square shaft section 122 that mateably engages square hole 86 in tab 84. A shoulder 124 is formed at the juncture of shaft sections 120 and 122. A coil spring 126 positioned on round shaft section 122 is compressed between tab 85 and shoulder 124. Spring 126 biases latching member 104 toward engagement with transverse member 56. The free end of round shaft section 120 is configured to receive a washer 128 and cotter pin 130 to securely hold latching member 104 on intermediate wall 112. Notably, washer 128 and cotter pin 130 are assembled through the aperture 132 (FIG. 6) in base plate 34 adjacent tab 85.

The caps 58 (FIG. 18) on the upper end of leg weight bearing members 51 include an end forming section of material 134 for abuttingly engaging ears (74) on the bottom of tabletop 32. Inner and outer tube-engaging sections 136 and 138 extend from end forming section 134, and define a groove therebetween for mateably receiving the end of tubular weight bearing member 51. Caps 58 are press-fit onto weight bearing members 51 and frictionally retained thereon, although it is within the present invention to also include other retention means such as fasteners or adhesives.

Figure 17:
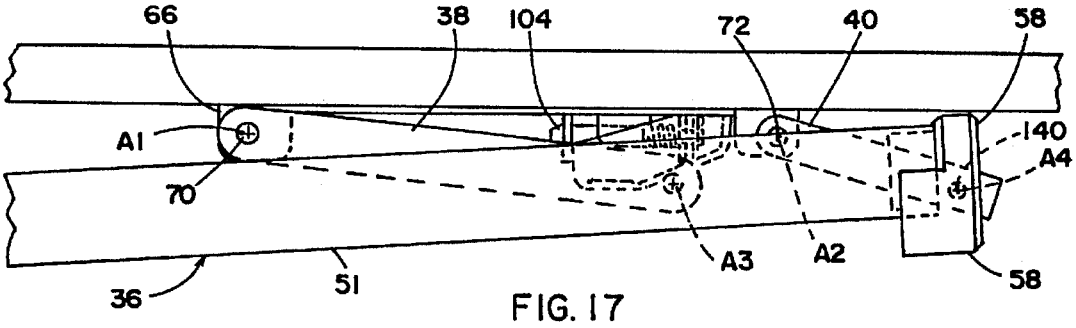
Figure 19:
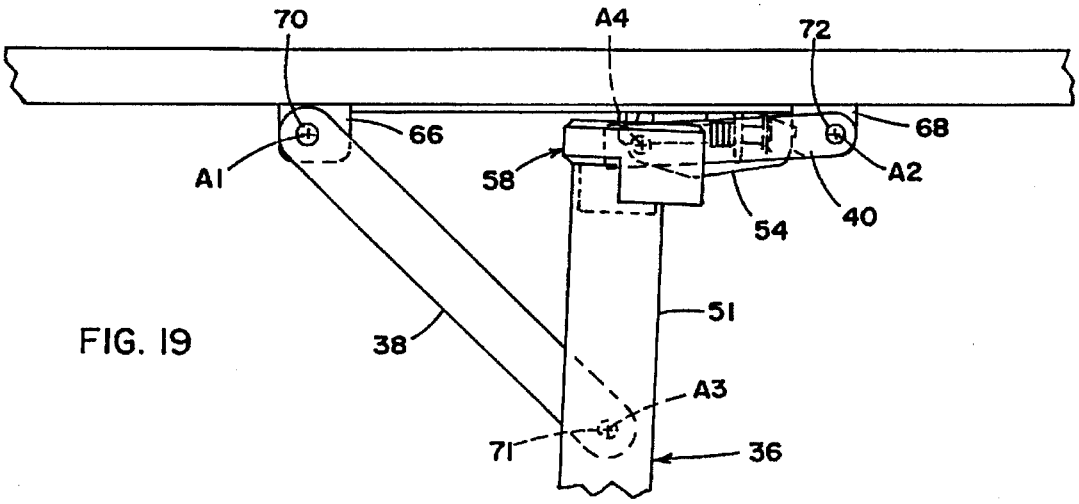

Pivot-forming holes 140 (FIG. 18) are located in end forming section 134 in a position offset from the longitudinal centerline 142 defined by weight bearing members 51. When leg 36 is in the folded position (FIG. 16), holes 140 (i.e. axis "A4") are located a greater distance from tabletop bottom surface 50 than pivot holes 67 and 69 (i.e. axes "A1" and "A2") in pivot-forming flanges 66 and 68. In particular, holes 140 are located below a plane "P" defined by axes "A1" and "A2." Also, holes 77 (i.e. axis "A3") in the upper ends 76 of leg 36 are also located below plane "P" when leg 36 is in the folded position. This avoids an "on center" or "over center" condition in which leg 36 is locked in the folded position by links 38 and 40. In particular, as leg 36 is moved from the folded position (FIG. 16) through the intermediate positions (FIGS. 17–19) to the extended latched use position (FIG. 4), the pivot points of link 40 (FIG. 16) are oriented at an angle so that link 40 does not lock up and bind and prevent leg 36 from being easily moved out of the folded position. As leg 36 reaches the extended position (FIG. 4 and 15), latching member 104 engages hole 96 in transverse section 52 of link 40 and axis "A4" is located "on center" on the plane P defined by axes "A1" and "A2" to stabilize leg 36. The spring 126 biases latching member 104 into frictional engagement with link 40, but permits leg 36 including link 40 to be conveniently moved from the extended position to the folded position. Notably, leg 36 is shifted laterally toward an end of table 30 by links 38 and 40 as leg 36 is folded, thus making greater/more efficient use of the room under tabletop 32 for storage of legs 36.

Accordingly, a table is provided including folding leg assemblies having a "four bar" linkage arrangement are movable to a securely latched extended position at which a latch securely engages a transverse member on one of the links. Also, the linkage arrangement moves the legs with an offset motion to maximize use of space under the tabletop and so that the legs can be folded flat against the bottom surface of the tabletop. Thus, legs including a transverse floor-engaging member interconnecting elongated weight bearing members can be folded flat against the underside of the tabletop even when the legs would normally be expected to strike each other if folded without the offset motion. Further, the legs are pivotally connected to the tabletop by a linkage arrangement which cooperates with a latch to provide a secure latched extended position and a flat folded position of the legs adjacent the tabletop bottom surface. Still further, the last movement of the leg into the extended position is perpendicular to the tabletop, thus creating a stable folded position wherein the leg is not likely to be accidentally bumped out of the extended position.

ALTERNATE EMBODIMENTS

Figure 22:
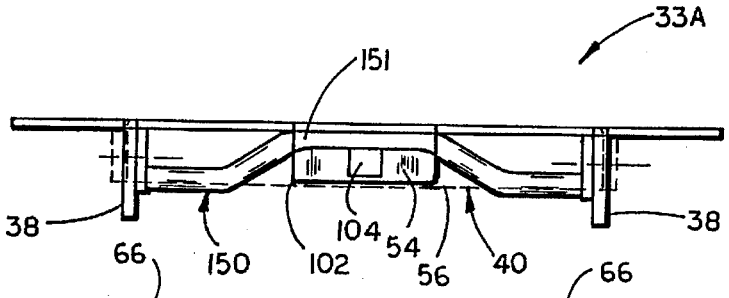
FIGS. 21–22 are plan and front views of the base plate, latch and H-shaped link shown in FIG. 20.
Figure 21:
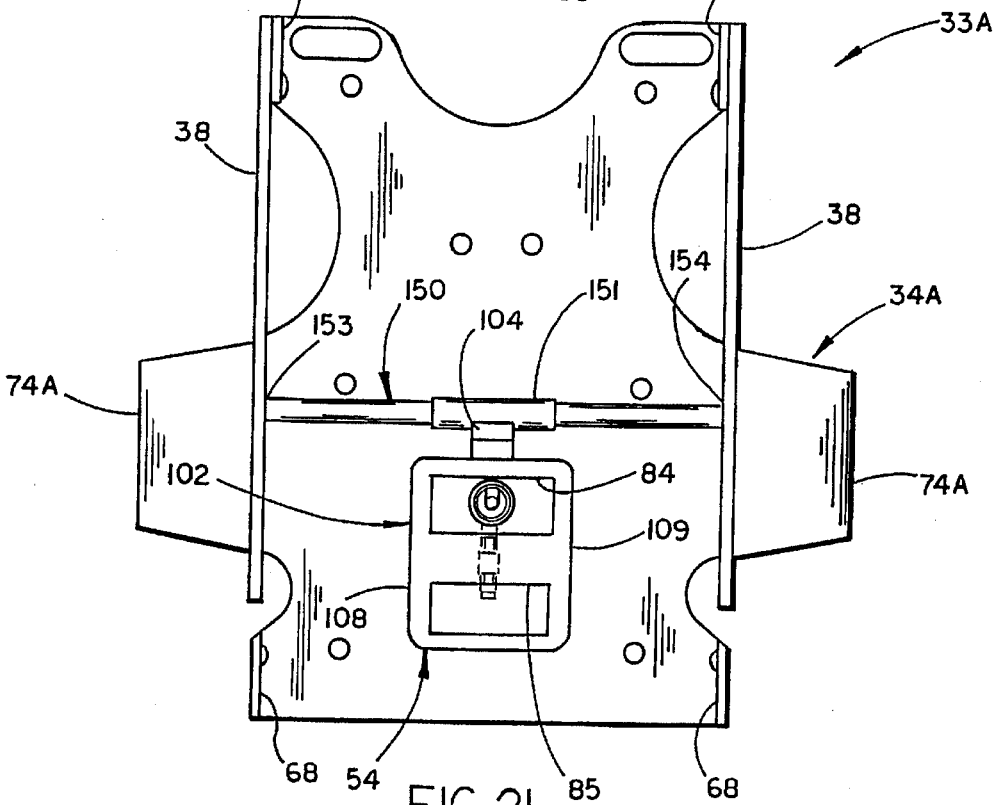
Figure 20:
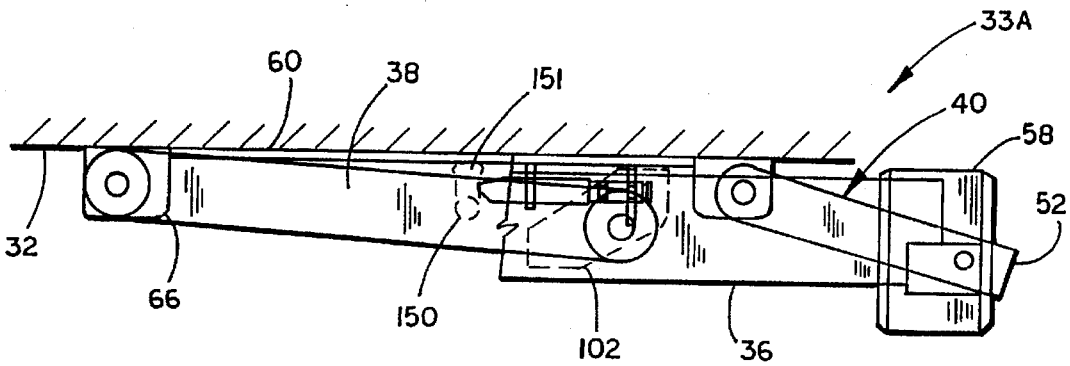
FIG. 20 is a fragmentary side view of a modified folding leg embodying the present invention, the folding leg including a transverse member and being latched in a folded position.

Modified folding leg assembly 33A (FIG. 20) is generally identical to folding leg assembly 33 (see FIG. 16), and identical and similar parts identified by identical numbers to eliminate redundant discussion. However, the intermediate side tabs 82 and 83 which are present on base plate 34 (FIG. 6) have been eliminated on base plate 34A (FIG. 21). In assembly 33A (FIG. 21), the side edges of tabs 84 and 85 retain latch housing 102 centrally thereon by engagement with housing sidewalls 108 and 109. Also in assembly 33A, a transverse member 150 is welded at locations 153 and 154 between links 38 to form an H-shaped link (FIGS. 21–22). Transverse member 150 has an offset center section 151 that is flattened and offset toward tabletop 32 so that center section 151 engages the tip of latching member 104 when folding leg 36 is in the folded position. Thus, latch 54 latchingly engages transverse member 150 when folding leg 36 is in the folded position and also engages a recess in transverse member 52 of U-shaped link 40 (FIG. 20) when in the extended position.

Figure 26:
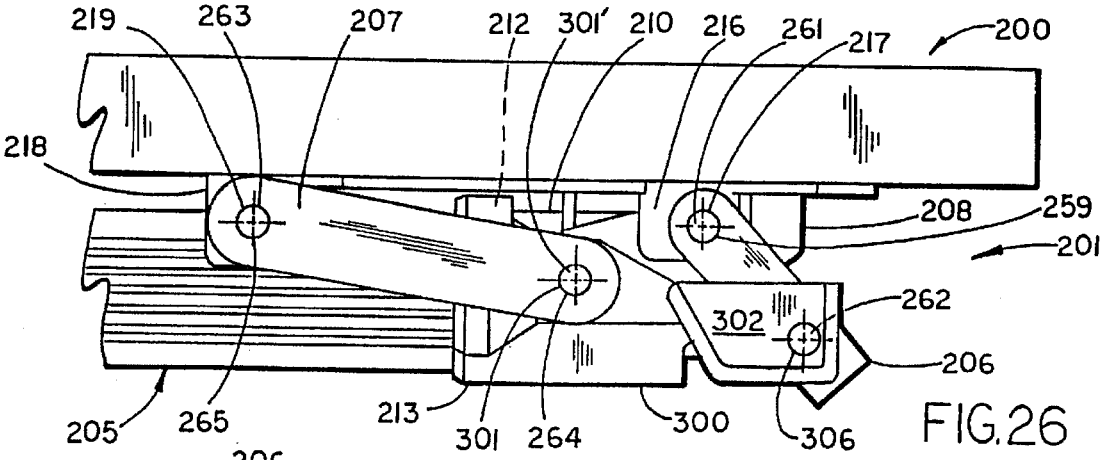
FIG. 26 is a fragmentary side view of the table shown in FIG. 24, the folding leg being shown in a folded position.
Figure 27:
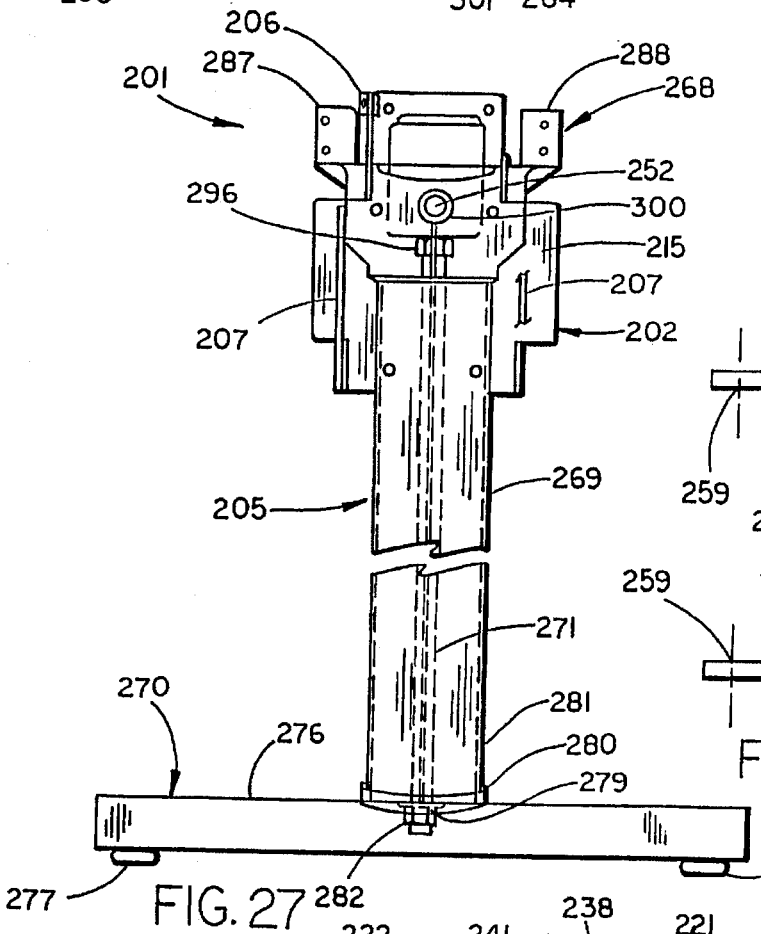
FIG. 27 is a plan view of the folding leg in the folded position shown in FIG. 26.

Another table 200 including a modified folding leg assembly 201 embodying the present invention is shown in an extended position in FIGS. 23–24 and in a folded position in FIGS. 26–27. Folding leg assembly 201 (FIGS. 23–24) includes a base plate or bracket 202 configured to attach to the underside of 203 of tabletop 204, and a folding leg 205 pivotally attached to base plate 202 by links 206 and 207 in a four bar linkage arrangement. A latch 208 is attached to base plate 202 generally along the longitudinal centerline of base plate 202. Latch 208 includes a latching member 210 for engaging a recess 211 in link 206 to hold folding leg 205 in an extended position (FIGS. 23–24) and for engaging a recess 212 in configured body or end section 213 of folding leg 205 to hold folding leg 205 in a folded position (FIGS. 26–27).

Figure 28:
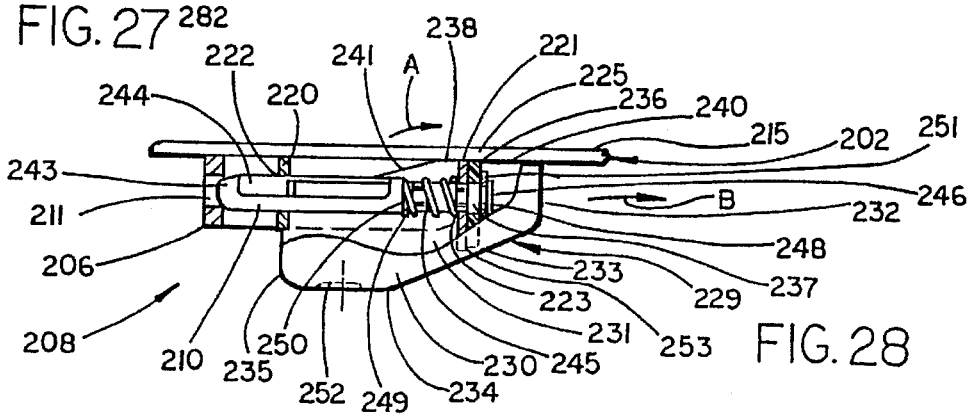
FIG. 28 is a side fragmentary cross-sectional view, partially broken away, of the latch shown in FIG. 27.
Figure 30:
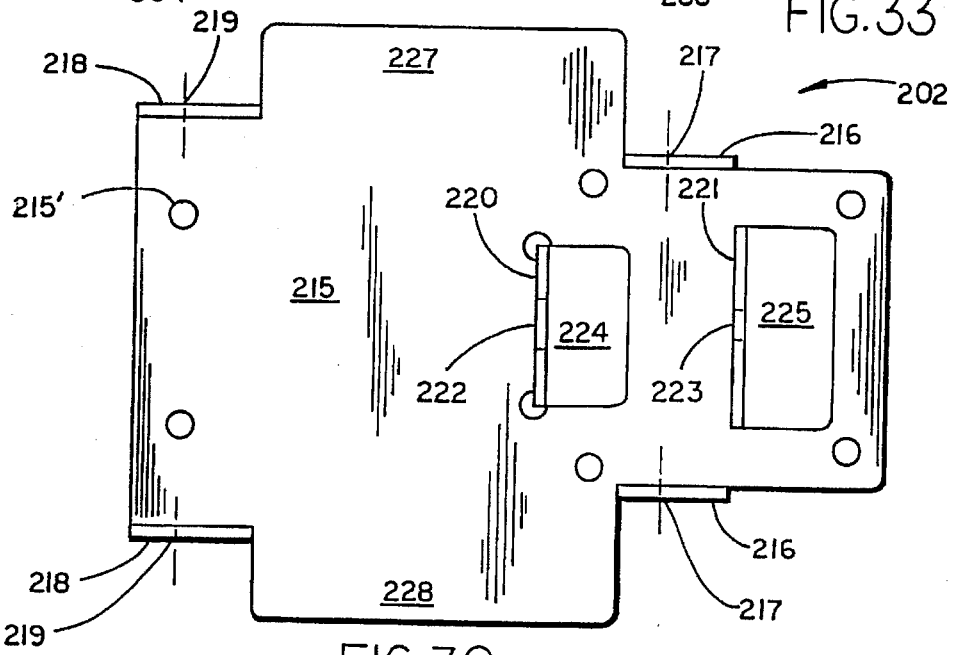
FIG. 30 is a plan view of the base plate shown in FIG. 27.

Base plate 202 (FIG. 30) includes a planar plate 215 having a pattern of holes 215' therein for receiving screws to secure base plate 202 to tabletop 204 (FIG. 24). A pair of pivots are defined on base plate 202. The first pivot (FIG. 30) includes spaced apart apertured tabs 216 with holes 217 therein defining a first axis of rotation. The second pivot includes spaced apart second tabs 218 with holes 219 therein defining a second axis of rotation. Upright center tabs 220 and 221 include apertures 222 and 223, respectively. Rectangular apertures 224 and 225 are formed in plate 215 in a location adjacent tabs 220 and 221, respectively, when tabs 220 and 221 are formed. Apertures 222 and 223 slideably receive and support latching pin 210 (FIG. 28). Side wings 227 and 228 (FIG. 30) extend from opposing sides of planar plate 215 to stabilize base plate 202 on tabletop 204.

Latch 208 (FIG. 28) includes a latch housing 229 having sidewalls 230 and 231, a rear wall 232, an inclined bottom wall 233, a bottom wall 234 and a front lip 235. An intermediate transverse wall 236 extends between sidewalls 230 and 231, and includes a hole for receiving a trailing end of latching pin 226. Sidewalls 230 and 231 include a generally horizontal first edge 240 that extends between transverse wall 236 and rear wall 232, and further include an inclined edge 241 that extends between transverse wall 236 and front lip 235. Edges 240 and 241 form a bearing surface 238 at their intersection to facilitate unlatching latching pin 226, as described hereinafter.

Latching pin 242 (FIG. 28) includes a bluntly pointed tip 243, a first rectangular shaft section 244, a reduced diameter second shaft section 245, and a tail section 246 having a ring-shaped depression 248 thereon. First shaft section 244 fits slideably mateably within aperture 222 in upright tab 220, and second shaft section 245 fits slideably mateably within the aperture 223 in upright tab 221 and also within aperture 237 in transverse wall 236. A coil spring 249 is positioned on second shaft section 245 and is compressed between the shoulder 250 on the trailing end of first shaft section 244 and against tab 221. A spring retainer 251 is installed through rectangular aperture 225 and is snap-locked onto the ring-shaped depression 248 against the rear side of transverse wall 236. Front lip 235 defines an aperture generally around front tab 220 with clearance. A depression 252 forms a push button on bottom wall 234. By pressing button 252, latch housing 229 rotates about an axis of rotation 253 at the bottom edge of tab 221 and slides at bearing surfaces 238 on bearing plate 215 generally in direction "A." This causes transverse wall 236 to move rearwardly, pulling latch pin 242 with it in direction B and against the biasing force of spring 249. In turn, this causes tip 243 of latch pin 242 to move to a retracted release position.

Figure 29:
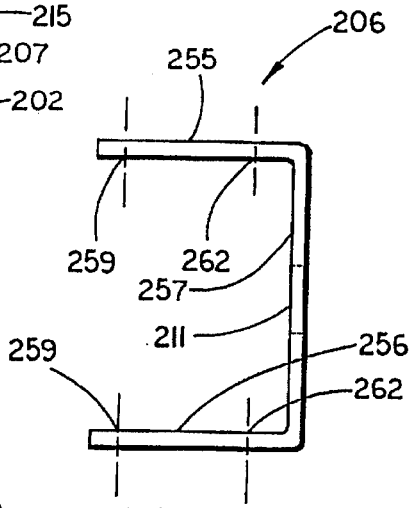
FIG. 29 is a plan view of the U-shaped bracket shown in FIG. 26.

Link 206 (FIG. 29) is U-shaped, and includes side members 255 and 256 connected by a transverse member 257. Recess 211 is located in transverse member 257. Transverse member 257 includes the aperture 211 configured to receive latch tip 243. Side members 255 and 256 include holes 259 proximate their ends. The ends of side members 255 and 256 are radiused concentrically with holes 259. Holes 259 align with holes 217 in tabs 216 (FIG. 26), and are engaged by pivot pins 261. A second pair of holes 262 (FIG. 29) are located inside members 255 and 256 spaced from holes 259, and define a third axis of rotation in the four bar linkage arrangement.

Parallel second links 207 (FIG. 26) are elongated flat sections having holes 263 and 264 at opposing ends. Holes 263 are alignable with holes 219 in tabs 218, and are secured thereto by pivot pins 265. Holes 264 define a fourth axis of rotation in the four bar linkage arrangement.

Folding leg 205 (FIG. 24) includes a configured body 268 forming an end section of leg 205, a tubular extrusion 269, a transverse floor support 270, and a tie rod 271 for holding body 268 and floor support 270 to opposing ends of extrusion 269. Extrusion 269 and floor support 270 form an inverted T-shaped arrangement under tabletop 204 when in the extended position. Extrusion 269 (FIG. 25) includes opposing concave sidewalls 272 and 273 connected by planar sidewalls 274 and 275 in a tubular shape. Sidewalls 274 and 275 include ribbed exterior surfaces that provide aesthetics and also strength. Transverse floor support 270 (FIG. 27) includes tubular cross piece 276 with spaced apart feet 277 and 278 attached to a bottom thereof. An aperture 279 is formed in the middle and top of cross piece 276 in a flattened depressed section. An aesthetic molded receptacle 280 fits into cross piece 276 to mateably receive the lower end 281 of extrusion 269. A nut 282 is tack-welded or otherwise held under aperture 279 and tie rod 271 is threaded into nut 282.

Figure 32:
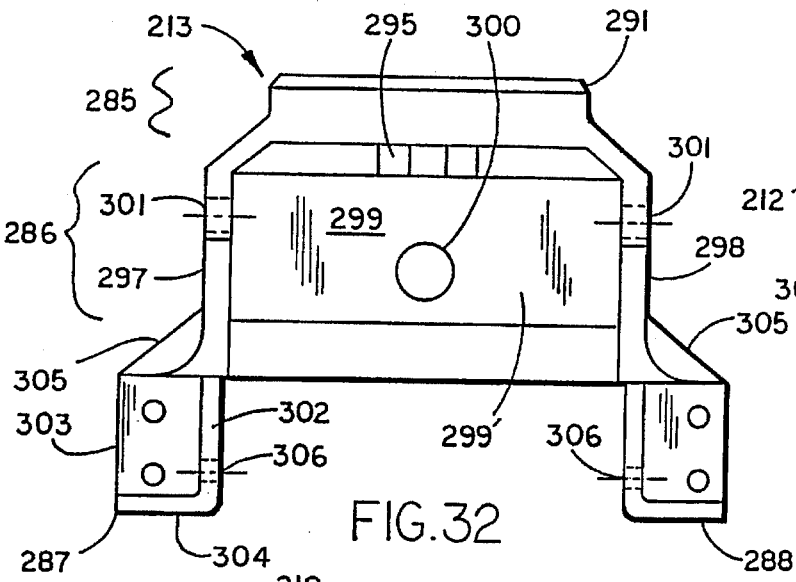
Figure 35:
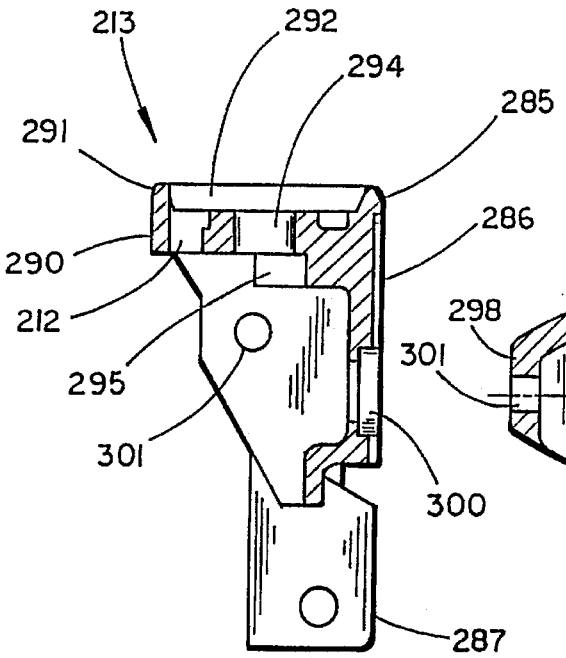
FIGS. 35–37 are cross-sectional views taken along the planes XXXV—XXXV, XXXVI—XXXVI and XXXVII—XXXVII in FIG. 34.

Configured body 213 (FIG. 32) includes an extrusion-engaging section 285, a pocket-forming section 286, and spaced apart pivot-forming arms 287 and 288 extending from pocket-forming section 286. Extrusion-engaging section 285 (FIG. 35) includes a transverse wall 290 having a geometrically-shaped lip 291 defining a depression 292 on its face for mateably receiving an upper end 293 of extrusion 269 (FIG. 24). A hole 294 (FIG. 35) is formed in transverse wall 290 for receiving tie rod 271, and half of a hexagonally surface 295 is formed on the back side of transverse wall 290 for receiving a hex nut 296 (FIG. 27) for threadably engaging tie rod 271. Recess 212 is located on a back side of transverse wall 290 under a reversely extending portion 291' of lip 291.

Figure 36:
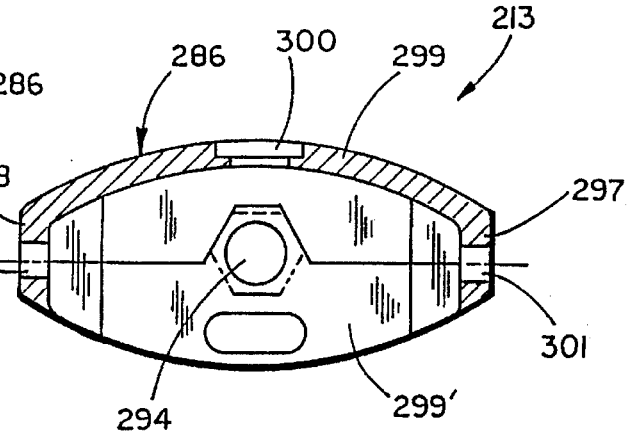
Figure 37:
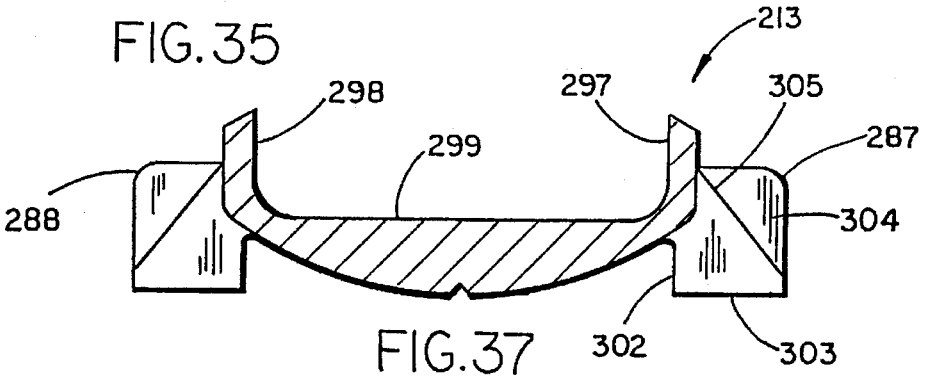
Figure 34:
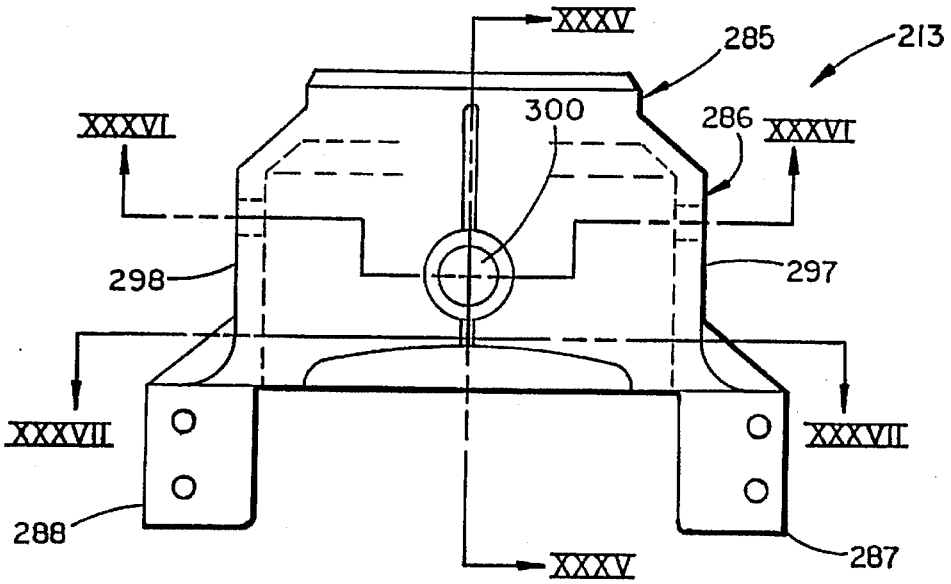
FIG. 34 is a bottom plan view of the molded configured body shown in FIGS. 31–33.

Pocket-forming section 286 (FIG. 36) includes sidewalls 297 and 298 connected by a curvilinear wall 299 defining a pocket 299'. A hole 300 is formed in curvilinear wall 299 so that button 252 on latch 208 (FIG. 27) can be accessed through hole 300 when folding leg 205 is in a folded position. Sidewalls 297 and 298 (FIG. 36) include holes 301 for alignment with holes 264 on link 207 (FIG. 26). Pivot pins 301' are extended into holes 301 and 264 to pivotally connect link 207 to configured body 268.

Figure 31:
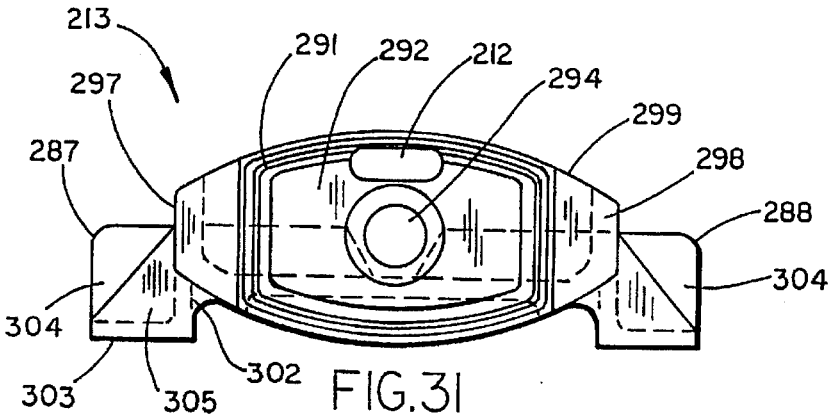
FIGS. 31–33 are end, top and side orthogonal views of the molded configured body attached to the end of the folding leg shown in FIG. 27.
Figure 33:
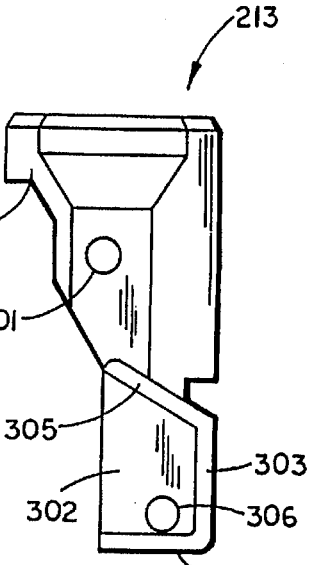

Pivot-forming axes 287 and 288 (FIGS. 31–33) are mirror images of each other, and thus only arm 287 will be described hereinafter. Arm 287 extends from an end and side of sidewall 297 and curvilinear wall 299. Arm 287 includes orthogonally related walls 302, 303 and 304, and a reinforcement wall 305 that extends diagonally from walls 303 and 304 onto sidewall 297. Hole 306 is located in arm inner wall 302, and is alignable with hole 262 in U link 206 (FIG. 26). Arms 287 and 288 are spaced apart and are configured to mateably receive U link 206 therebetween with the outside surfaces of U links 206 engaging inner surfaces 302 on arms 287 and 288. Pocket 299' is shaped to mateably receive latch housing 229 when in the folded position.

When folding leg 205 is in a folded position (FIGS. 26–27), latching pin 242 engages recess 212, and latch 208 is positioned in pocket 299'. An operator can release latch 208 by extending a finger through access hole 300 to press on depression button 252. This causes latch housing 229 to rotate about axis 253, which in turn cause latching pin 242 to move to a release position. When released, folding leg 205 can be moved to an extended position. In the extended position (FIGS. 23–24), configured body 268 abuts base plate 202 and latching pin 242 latches into notch 211 in U-shaped link 206. To unlatch latch 208, depression button 252 is again depressed. This causes latching pin 242 to release, as previously described.

Notably, it is contemplated that transverse member 257 (and recess 211) could be incorporated into configured body 213 so that it extends between arms 287 and 288. In such case, link parallel side members 255 and 256 would be pivoted to the outside of arms 255 and 256. The operation of this modification would be comparable to the embodiment described above.

Thus, there is provided a table including folding leg assemblies connected to a tabletop. The folding leg assemblies include a folding leg connected to a base plate by links that form a four bar linkage arrangement. A latch is provided for latching each folding leg, and is positioned to selectively hold the folding leg in an extended position and also in a folded position.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A table comprising:

a tabletop;

a folding leg including a post and a polymeric molded body secured to an end of the post, said molded body including a depression for mateably receiving the end of the post;

a four bar linkage arrangement movably connecting said folding leg to said tabletop for movement between an extended position for supporting said tabletop and a folded position for storage, said four bar linkage arrangement including a plurality of interconnected links, said molded body forming one of said links; and a releasable latch positioned to releasably engage said one link to stabilize the table when said folding leg is in said extended position, and to releasably engage one of said links to stabilize the leg against the table when said folding leg is in said folded position.

2. A table as defined in claim 1 wherein said links include first and second links, and said latch engages said first link when in said extended position and engages said second link when in said folded position.

3. A table as defined in claim 2 wherein said first link includes a pair of spaced apart side members and a transverse member forming a U-shape, said latch engaging said transverse member when in said extended position.

4. A table as defined in claim 3 wherein said tabletop is elongated and said latch is secured to the bottom of said tabletop along a centerline defined by said tabletop.

5. A table as defined in claim 4 wherein said second link includes a second transverse member and a pair of second spaced side members connected to said second transverse member, said latch engaging said second transverse member when in said folded position.

6. A table as defined in claim 1 wherein one of said links includes a transverse member for engaging said latch.

7. A table as defined in claim 6 wherein said links include first, second, third and fourth links, and said first link is operably connected between said third and fourth links, and wherein said second link is also operably connected between said third and fourth links.

8. A table as defined in claim 7 wherein an end of said folding leg forms said second link.

9. A table as defined in claim 8 wherein said linkage arrangement includes a base plate attached to said tabletop, said base plate forming said fourth link.

10. A table as defined in claim 1 wherein said links include a first link, and said first link includes a pair of spaced apart side members and a transverse member connecting said spaced apart side members, said latch engaging said transverse member when in said folded position.

11. A table as defined in claim 1 wherein said molded body has a recess therein configured to engage said latch when in said folded position.

12. A table as defined in claim 1 wherein said latch is secured to an underside surface of said tabletop.

13. A table as defined in claim 1 wherein said tabletop includes a base plate secured to an underside of said tabletop, said linkage arrangement being pivotally secured to said base plate with said base plate forming one of said links.

14. A table as defined in claim 1 wherein said folding leg includes an end section forming a first link, said first link being the one link releasably engaged by said latch when said folding leg is in said folded position.

15. A table as defined in claim 14 wherein said folding leg includes a single post and defines an inverted T-shape when in said extended position.

16. A table comprising:

a tabletop;

a folding leg;

a four bar linkage arrangement movably connecting said folding leg to said tabletop for movement between an extended position for supporting said tabletop and a folded position for storage, said four bar linkage arrangement including a plurality of interconnected links;

a releasable latch positioned to releasably engage one of said links to stabilize the table when said folding leg is in said extended position, and to releasably engage one of said links to stabilize the leg against the table when said folding leg is in said folded position; and said latch being secured to an underside surface of said tabletop, said latch including a latching member slidably moveable generally parallel said underside surface.

17. A table comprising:

a tabletop;

a base plate attached to said tabletop, said base plate defining first and second pivots defining spaced apart axes of rotation;

a folding leg having an end section defining third and fourth pivots defining spaced apart axes of rotation, said folding leg being movable between an extended position and a folded position, said folding leg including an elongated member and said end section comprising a configured body secured to said elongated member, said configured body being a polymeric molding having a recess therein for receiving an end of the elongated member;

a first link having a first end pivotally connected to said first pivot and a second end pivotally connected to said third pivot;

a second link having a third end pivotally connected to said second pivot and a fourth end pivotally connected to said fourth pivot; and a latch attached to said base plate, said latch including a latching member positioned to engage one of said first link and said end section of said folding leg when said folding leg is in said extended position, and to engage one of said second link and said folding leg when in said folded position.

18. A table comprising:

a tabletop;

a base plate attached to said tabletop, said base plate defining first and second pivots defining spaced apart axes of rotation;

a folding leg having an end section defining third and fourth pivots defining spaced apart axes of rotation, said folding leg being movable between an extended position and a folded position;

a first link having a first end pivotally connected to said first pivot and a second end pivotally connected to said third pivot;

a second link having a third and pivotally connected to said second pivot and a fourth end pivotally connected to said fourth pivot;

a latch attached to said base plate, said latch including a latching member positioned to engage one of said first link and said end section of said folding leg when said folding leg is in said extended position, and to engage one of said second link and said folding leg when in said folded position; and said folding leg including an elongated member and said end section comprising a configured body secured to said elongated member.

19. A table as defined in claim 18 wherein said folding leg includes a tie rod extending along said elongated member that secures said elongated member to said configured body.

20. A table leg construction comprising:

a base plate configured for attachment to a tabletop;

a latch attached to said base plate;

a folding leg including a configured end section of molded material, an extrusion mateably engaging a recess in said end section, and a tie rod holding said extrusion against said end section; and a linkage arrangement operably connecting said folding leg to said base plate for movement between an extended position and a folded position, said end section forming a link in said linkage arrangement and being engaged by said latch when in one of said extended position and said storage position.

21. A table leg construction as defined in claim 20 wherein said configured end section includes a notch engaged by said latch when said folding leg is in said one position.

22. A table leg construction as defined in claim 21 wherein said one position is said folded position.

* * * * *